US009112299B2

(12) United States Patent
Lu et al.

(10) Patent No.: US 9,112,299 B2
(45) **Date of Patent: *Aug. 18, 2015**

(54) WATERPROOF ELECTRICAL CONNECTOR AND METHOD FOR MAKING THE SAME

(71) Applicant: HON HAI PRECISION INDUSTRY CO., LTD., New Taipei (TW)

(72) Inventors: Cen Lu, Kunshan (CN); Jing-Jie Guo, Kunshan (CN); Wen-Zhang Lin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/255,090

(22) Filed: Apr. 17, 2014

(65) Prior Publication Data

US 2014/0315421 A1 Oct. 23, 2014

(30) Foreign Application Priority Data

Apr. 18, 2013 (CN) ..... 2013 1 01351161

(51) Int. Cl.

| | |
|---|---|
| ***H01R 13/64*** | (2006.01) |
| ***H01R 13/52*** | (2006.01) |
| ***H01R 43/00*** | (2006.01) |
| ***H01R 24/62*** | (2011.01) |
| ***H01R 43/24*** | (2006.01) |
| *H01R 12/72* | (2011.01) |
| *H01R 13/405* | (2006.01) |

(52) U.S. Cl.

CPC ..... *H01R 13/5227* (2013.01); *H01R 24/62* (2013.01); *H01R 43/005* (2013.01); *H01R 43/24* (2013.01); *H01R 12/724* (2013.01); *H01R 13/405* (2013.01); *Y10T 29/4922* (2015.01)

(58) Field of Classification Search

CPC ..... H01R 13/65802; H01R 13/2442
USPC ..... 439/374, 607.01, 701, 260, 626
See application file for complete search history.

(56) References Cited

U.S. PATENT DOCUMENTS

| | | | | |
|---|---|---|---|---|
| 7,112,087 | B2 | 9/2006 | Tago et al. | |
| 7,682,199 | B2 | 3/2010 | Ahn et al. | |
| 8,801,463 | B2 * | 8/2014 | Tan et al. | 439/607.04 |
| 2013/0183845 | A1 * | 7/2013 | Tan et al. | 439/271 |
| 2014/0315413 | A1 * | 10/2014 | Lu | 439/350 |

FOREIGN PATENT DOCUMENTS

| | | |
|---|---|---|
| CN | 102403618 | 4/2012 |
| JP | 4875130 | 5/2011 |

* cited by examiner

*Primary Examiner* — Phuongchi T Nguyen
(74) *Attorney, Agent, or Firm* — Ming Chieh Chang; Wei Te Chung

(57) ABSTRACT

A waterproof electrical connector (100) includes a number of terminals (2), a metallic shell (1), and an insulating housing (3) molded outside of the metal shell (1) to thereby define a passageway (10). The insulating housing (1) includes a base portion (33) and a tongue portion (31) extending forwardly from the base portion (33). The base portion (33) includes at least one mold cavity (331) for inserting a mold. The mold cavity (331) and the passageway (10) are spaced apart from each other along the insertion/extraction direction for having better waterproof function.

17 Claims, 9 Drawing Sheets

WATERPROOF ELECTRICAL CONNECTOR AND METHOD FOR MAKING THE SAME

BACKGROUND OF THE INVENTION

1. Field of the Invention

The present invention relates generally to a waterproof electrical connector and method for making the same, and more particularly to a waterproof electrical connector having better waterproof function.

2. Description of Related Arts

Universal Serial Bus (USB) interfaces are widely used in various electronic devices. In recent years, a micro USB interface is introduced to meet miniaturization requirement of electronic devices. Japan Patent No. 4875130 discloses an electrical connector comprising a metallic shell, a plurality of terminals received in the metallic shell and an insulative housing insert-molded with the metallic shell and the terminals. The metallic shell defines a passageway for inserting a mating connector. The insulative housing comprises a base portion, a tongue portion extending from the base portion and forwardly into the passageway of the metallic shell, and a cover portion extending forwardly from end edges of the base portion for covering the metallic shell by insert-molding. Each terminal includes a contact portion retained to while exposing out of the tongue portion. To make the electrical connector, firstly, a first mold is inserted in the passageway along an insertion direction to resist against one end of the contact portion for fixing the terminal. Secondly, a second mold is inserted in the passageway along an extraction direction opposite to the insertion direction to resist against another end of the contact portion for fixing the terminal. Then, the insulative housing is insert-molded with the metallic shell and the terminals. Waterproof/sealing effect of the electrical connector thus made need be improved; besides, the insulative housing might crack at a rear end of the tongue portion.

It is desired to have a waterproof electrical connector, and method for making the same, which has improved waterproof/sealing effect.

SUMMARY OF THE INVENTION

Accordingly, an object of the present invention is to provide a waterproof electrical connector and method for making the same, which has better waterproof/sealing effect and is easy to make.

To achieve the above object, a waterproof electrical connector includes a number of terminals, a metallic shell and an insulating housing molding outside of the metal shell defining a passageway. The insulating housing includes a base portion and a tongue portion extending forwardly from the base portion. The base portion includes at least one mold cavity for inserting a mold. The mold cavity and the passageway are spaced apart from each other along the insertion/extraction direction for having better waterproof function.

Other objects, advantages and novel features of the invention will become more apparent from the following detailed description when taken in conjunction with the accompanying drawings.

DETAILED DESCRIPTION OF THE PREFERRED EMBODIMENT

Figure 1:
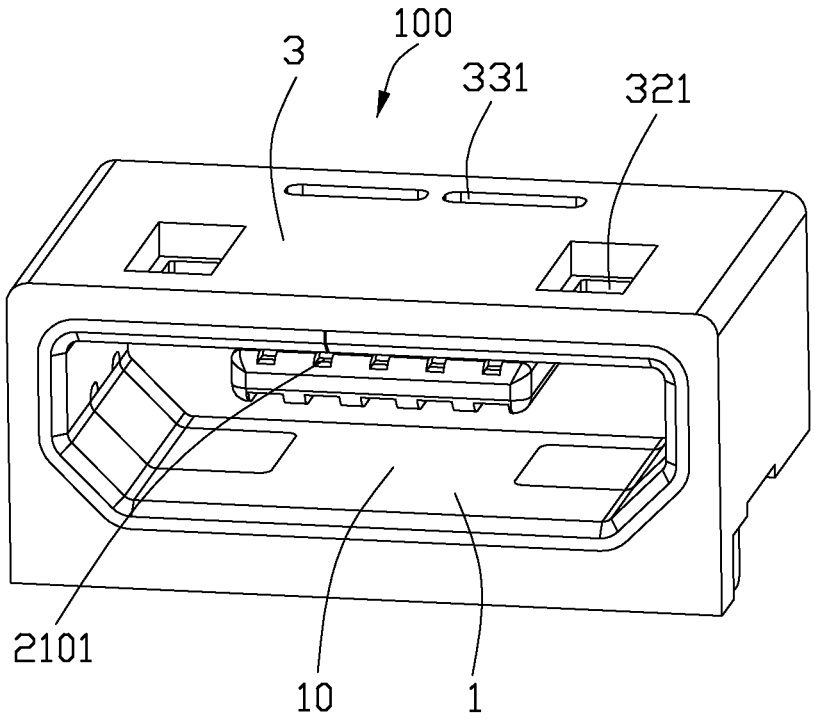
FIG. 1 is a perspective, assembled view of a waterproof electrical connector according to a first embodiment of the present invention.

Reference will now be made in detail to the preferred embodiment of the present invention.

FIGS. 1 to 5 show a first embodiment of the present invention. A waterproof electrical connector 100 comprises a metallic shell 1, a plurality of terminals 2 partly received in the metallic shell 1, and an insulative housing 3 fixed with the metallic shell 1 and the terminals 2 by insert-molding. The waterproof electrical connector 100 defines an insertion direction and an extraction direction opposite to the insertion direction.

Referring to FIGS. 1 to 5, the metallic shell 1 comprises a bottom wall 12, a top wall 11 facing to the bottom wall 12 and defining a joint 123, a pair of side walls 13 connecting with the bottom wall 12 and the top wall 11, all the walls jointly forming a passageway 10 for inserting a mating connector (not shown). The top wall 11 defines a pair of slots 111 through which a pair of latches (not shown) on the mating connector can extend. Each side wall 13 comprises at least one engaging section 131 extending downwardly from a lower edge thereof. The engaging section 131 is perpendicular to the bottom wall 12 for connecting with a printed circuit board (not shown). The bottom wall 12 comprises a pair of retaining legs 121 extending upwardly from a rear end thereof and a cutout 122 between the pair of retaining legs 121. The retaining legs 121 are fixed in the insulative housing 3 by insert-molding for securing the metallic shell 1 with the insulative housing 3.

Figure 4:
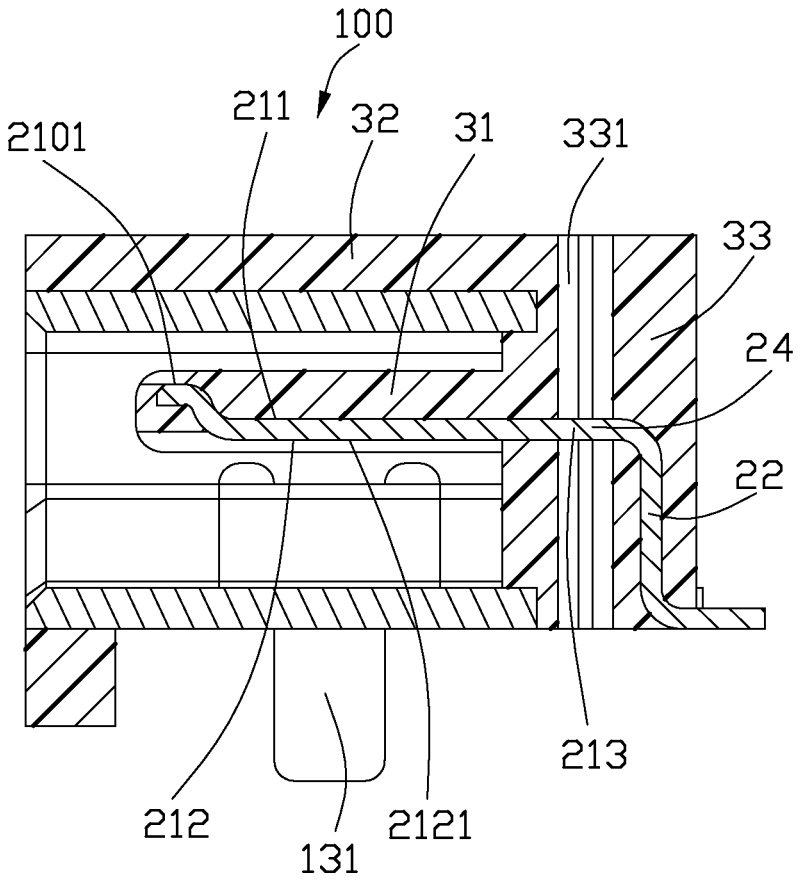
FIG. 4 is a cross-sectional view of the waterproof electrical connector taken along line 4-4 of FIG. 3.
Figure 5:
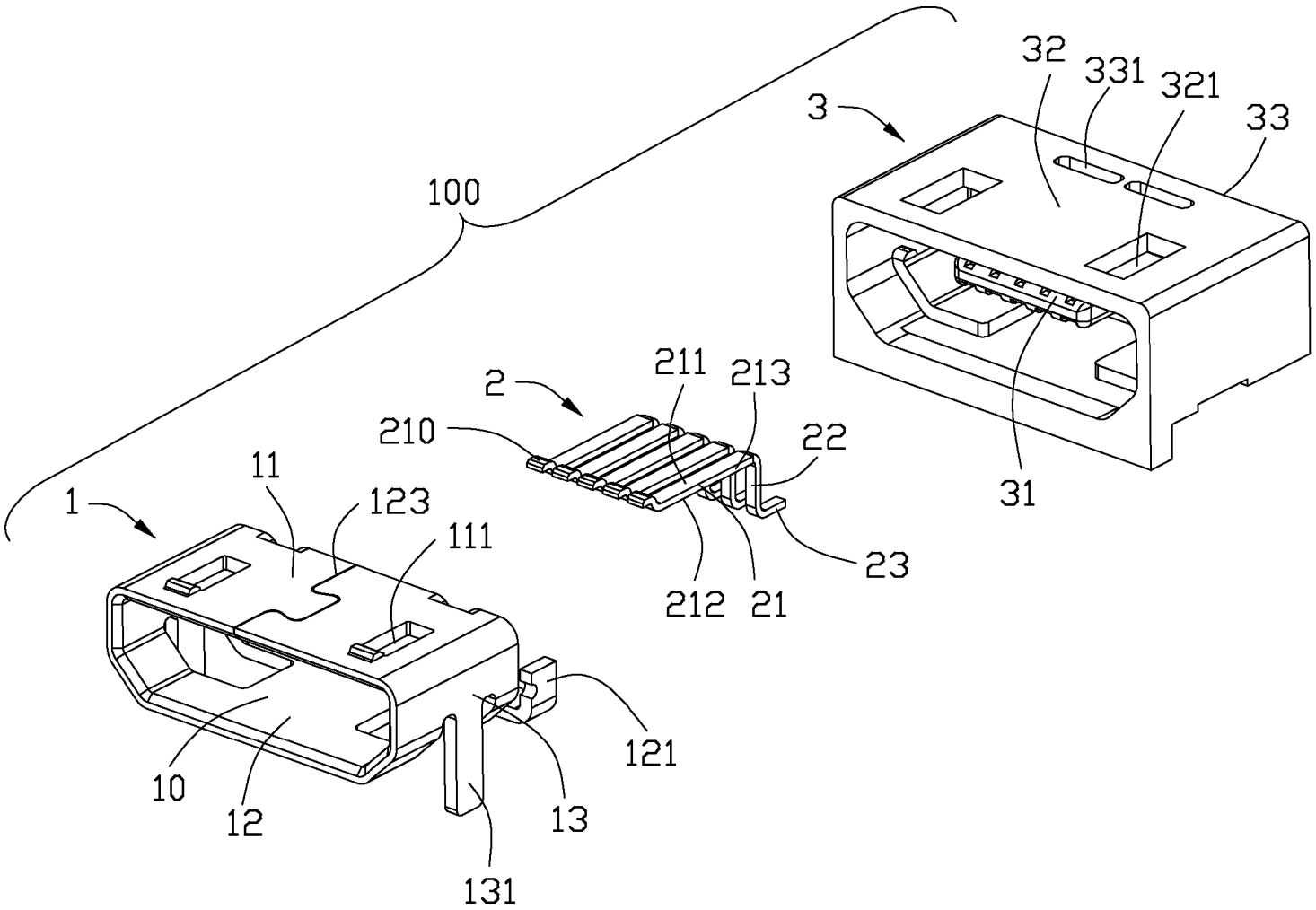
FIG. 5 is a perspective, exploded view of the waterproof electrical connector in FIG. 1.
Figure 6:
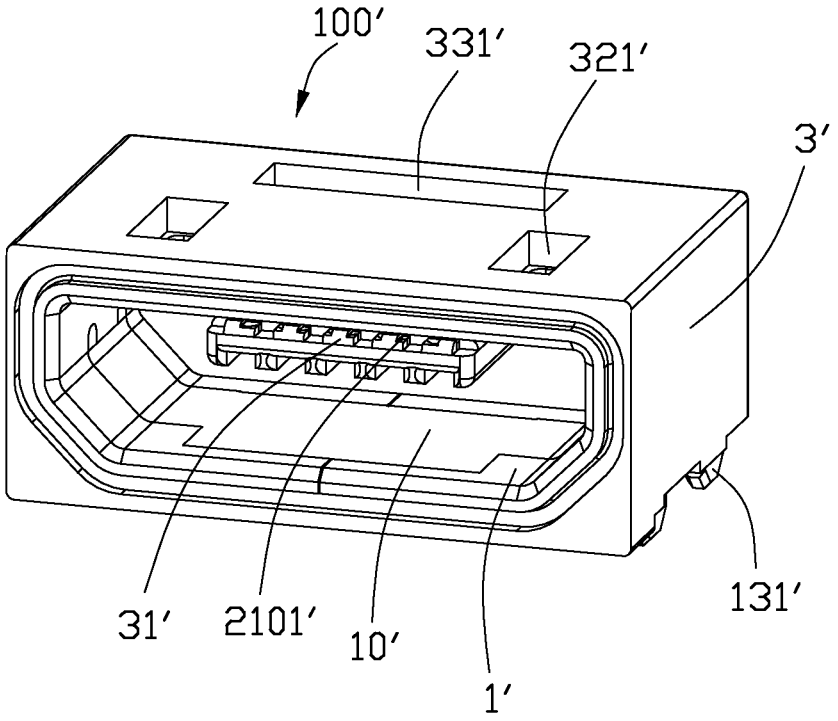
FIG. 6 is a perspective, assembled view of a waterproof electrical connector according to a second embodiment of the present invention.
Figure 7:
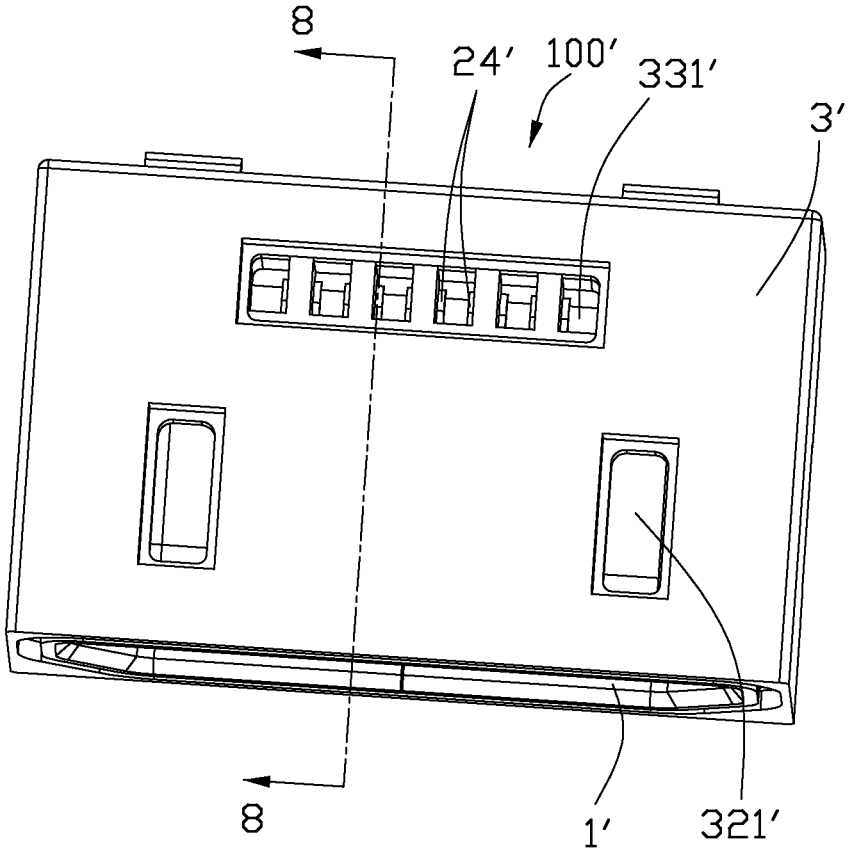
FIG. 7 is another perspective, assembled view of the waterproof electrical connector in FIG. 6.
Figure 8:
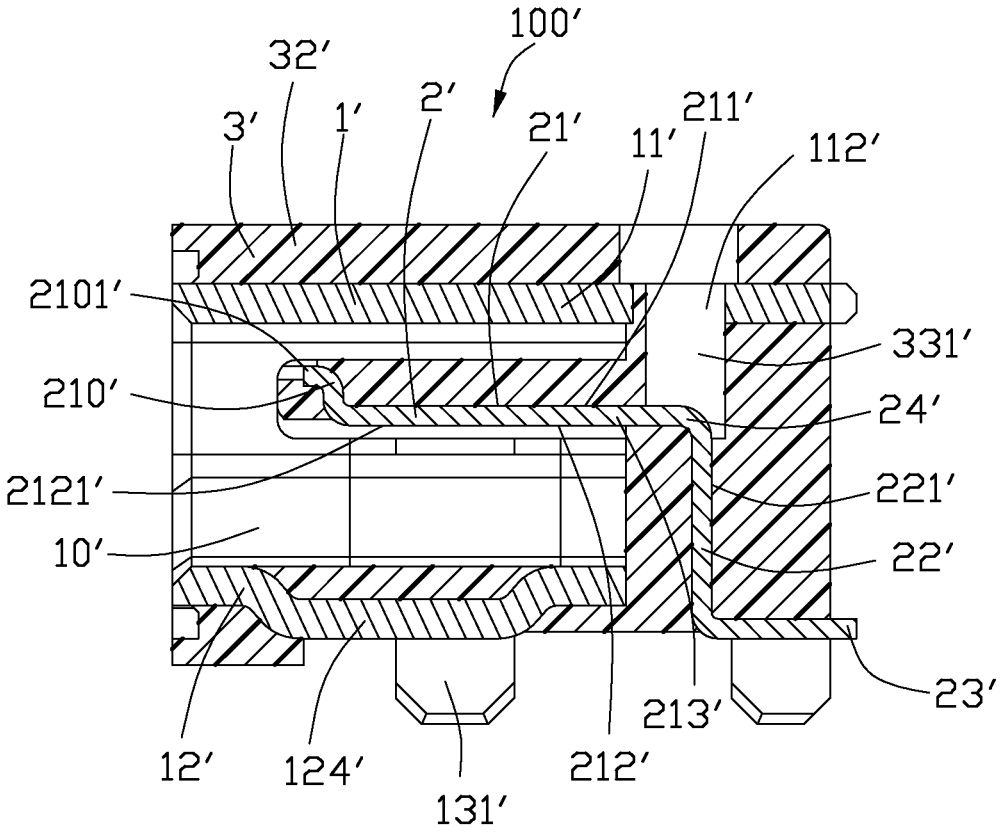
FIG. 8 is a cross-sectional view of the waterproof electrical connector taken along line 8-8 of FIG. 7.
Figure 9:
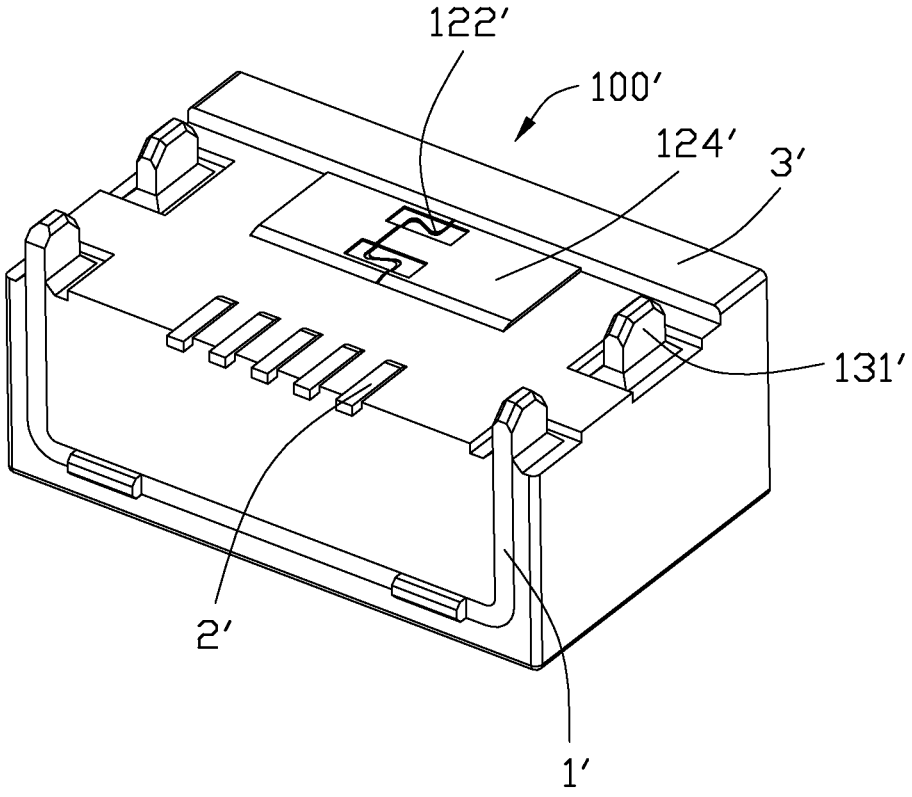
FIG. 9 is still another perspective, assembled view of the waterproof electrical connector in FIG. 6.

Referring to FIGS. 4 and 5, the terminals 2 are made of metal material. Each terminal 2 comprises a contacting portion 21, a retaining portion 22 extending vertically and downwardly from a rear end of the contacting portion 21, and a soldering portion 23 extending backwardly from a free end of the retaining portion 22. The contacting portion 21 includes a Z-shaped end portion 210 at a front end thereof.

Figure 2:
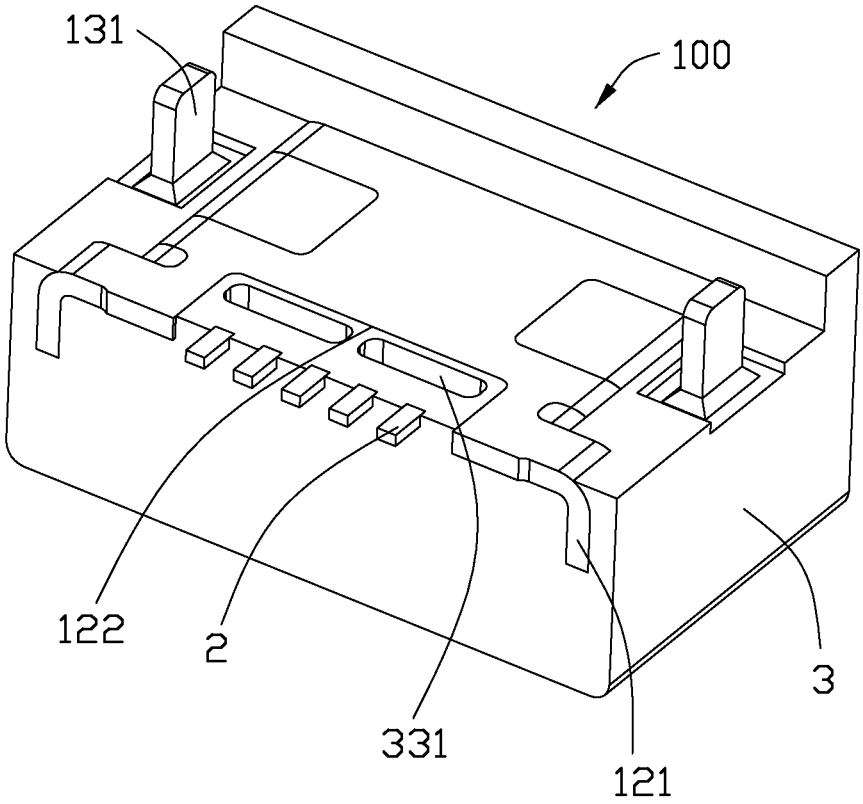
FIG. 2 is another perspective, assembled view of the waterproof electrical connector in FIG. 1.
Figure 3:
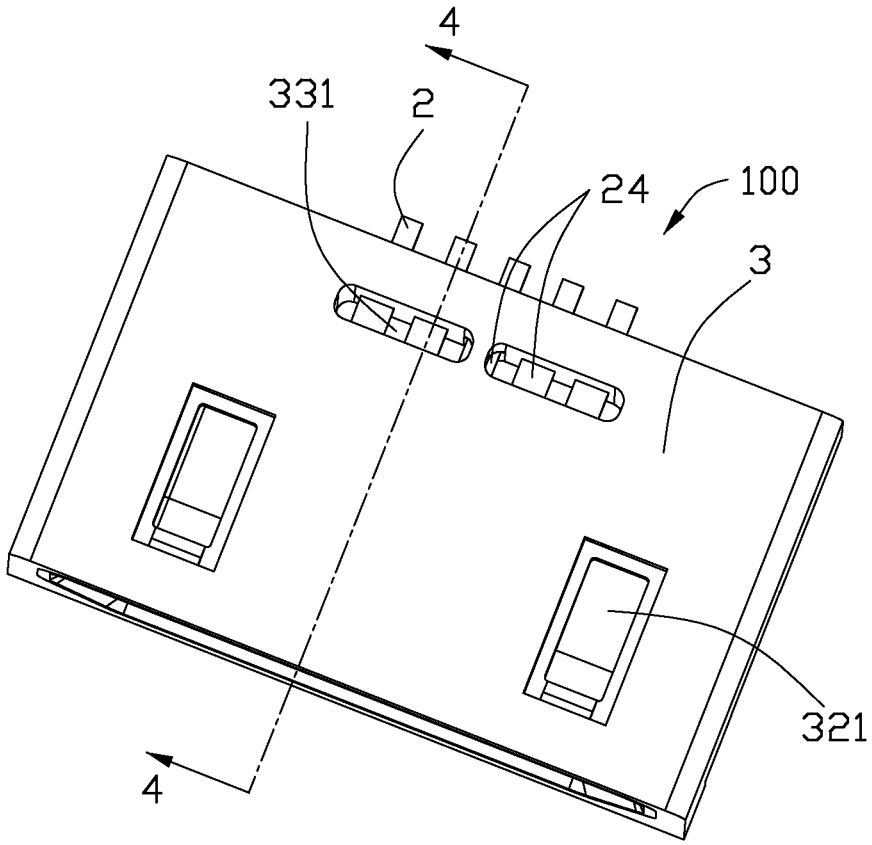
FIG. 3 is still another perspective, assembled view of the waterproof electrical connector in FIG. 1.

Referring to FIGS. 1, 2, and 4, the insulative housing 3 is insert-molded with the metallic shell 1 and the terminals 2. The insulative housing 3 comprises a base portion 33, a tongue portion 31 extending from a middle of the base portion 33 and forwardly into the passageway 10 of the metallic shell 3, and a cover portion 32 extending forwardly from end edges of dithe base portion 31 for covering the metallic shell 1 by insert-molding. The cover portion 32 comprises a pair of holes 321 in communication with the slots 111 for latching with a pair of latches formed on the mating connector. The base portion 33 has at least one mold cavity 331 (shown in FIG. 4) extending therethrough along a first direction perpendicular to the top wall 11 for inserting a mold (not shown). In the first embodiment of the present invention, the mold cavity 331 and the passageway 10 are spaced apart from each other along the insertion/extraction direction to have good waterproof function.

In the first embodiment of the present invention, a method for making the waterproof electrical connector 100 are made as described below.

First is to provide the metallic shell 1 and the plurality of terminals 2. The contacting portions 21 of the terminals 2 are inserted in the passageway 10 from the rear end of the metasllic shell 1 along the extraction direction. Each contacting portion 21 of the terminal 2 defines an upper surface 211, a lower surface 212, and a side surface 213 (shown in FIGS. 4 and 5).

Secondly, provide at least one first mold (not shown) to press against the upper surface 211, the side surface 213, and the lower surface 212 of the contacting portion 21. The first mold is located at the rear end of the contacting portion 21. And then insert at least one second mold (not shown) in the passageway 10 along the insertion direction for pressing against the upper surface of the end portion 210 and the lower surface of the contacting portion 21. In the first embodiment of the present invention, the contacting portion 21 defines a contacting region 24 pressing against the first mold. The first mold is used for positioning the rear end of the contacting portion 21. The second mold is used for positioning the front end of the contacting portion 21 and preventing the end portion 210 of the contact portion 21 from warping.

Thirdly, provide at least one third mold (not shown), and optionally a peripheral mold (not shown), for positioning the metallic shell 1. The insulative housing 3 is formed by insert-molding. The material strips (not shown) of the metallic shell 1 and the terminals 2 are cut off Lastly, remove the first mold, the second mold, and the third mold (and the peripheral mold if there is), thereby defining the mold cavity 331.

Referring to FIGS. 1 to 4, the contacting regions 24 of the terminals 2 are located in the base portion 33 of the insulative housing 3 and exposed outwardly via the mold cavity 331 along the first direction perpendicular to the top wall 11. The first mold and/or the mold cavity 331 is located behind the passageway 10 for having good waterproof/sealing effect. Only a part of the contacting portion 21 is exposed out of the tongue portion 31 and pressed against by the second mold.

Referring to FIGS. 6 to 9, a waterproof electrical connector 100' according to a second embodiment of the present invention is disclosed. The waterproof electrical connector 100' also comprises a metallic shell 1', a plurality of terminals 2' partly received in the metallic shell 1', and an insulative housing 3' fixed with the metallic shell 1' and the terminals 2' by insert-molding. The waterproof electrical connector 100' also defines an insertion direction and an extraction direction opposite to the insertion direction.

Referring to FIGS. 6 to 9, the terminals 2' and the metallic shell 1' are approximately same to those in the first embodiment. The difference between the waterproof electrical connectors 100', 100 in the first and second embodiments is that, firstly, the top wall 11' is longer than that in the first embodiment, and the top wall 11' extends rearwardly and out of a rear end of the insulative housing 3'. Secondly, the top wall 11' has at least one mold hole 112' (shown in FIG. 8) extending therethrough along the first direction perpendicular to the top wall 11' for inserting the first mold. Thirdly, the bottom wall 12' comprises a protruding portion 124' and has a joint 122'. The insulative housing 3' covers at least one surface of the bottom wall 12' for better securing the metallic shell 1 with the insulative housing 3 and having good waterproof/sealing effect.

The main difference between the waterproof electrical connectors 100', 100 in the first and second embodiments is that: the first mold presses against the upper surface 211', the side surface 213' of the contacting portion 21', and a rear surface of the retaining portion 22' (shown in FIG. 8), and the mold cavity 331' only extends through an upper surface of the base portion 33 and in communication with the mold hole 112' along the first direction perpendicular to the top wall 11' (shown in FIG. 8) for inserting the first mold.

The second embodiment of the present invention also discloses a method for making the waterproof electrical connector 100' comprising the steps described below.

S1, providing the metallic shell 1' and the plurality of terminals 2'. The contacting portions 21' of the terminals 2' are inserted in the passageway 10' from the rear end of the metallic shell 1' along the extraction direction. Each contacting portion 21' of the terminal 2' defines an upper surface 211', a lower surface 212', and a side surface 213' (shown in FIG. 8). Each retaining portion 22' defines a rear surface 221' and a lateral surface.

S2, inserting at least one first mold (not shown) through the mold hole 112' along the first direction perpendicular to the top wall 11'. The first mold presses against the upper surface 211' of the contacting portion 21', the rear surface 221' of the retaining portion 22', and the side surface 213' of the contacting portion 21' or/and the lateral surface of the retaining portion 22'. The first mold is located at the rear end of the contacting portion 21'. At least one second mold (not shown) is inserted in the passageway 10' along the insertion direction for pressing against the upper surface 211' of the end portion 210', the side surface 213' of the end portion 210', and the lower surface of the contacting portion 21. In the second embodiment of the present invention, the contacting portion 21' defines a 7-shaped contacting region 24' pressed against by the first mold. The first mold is used for positioning the rear end of the contacting portion 21'. The second mold is used for positioning the front end of the contacting portion 21' and preventing the end portion 210' of the conatact portion 21' from warping.

S3, providing at least one third mold (not shown) and/or a peripheral mold (not shown) for positioning the metallic shell 1'. The insulative housing 3' is formed by insert-molding. Material strips are cut off the metallic shell 1' and the terminals 2'. Lastly, the first mold, the second mold, and the third mold (and the peripheral mold if present) are removed to thereby define the mold cavity 331'.

Referring to FIGS. 6 to 9, the contacting regions 24' of the terminals 2' are located in the base portion 33' of the insulative housing 3' and only exposed outwardly from the upper surface of insulative housing 3' via the mold cavity 331' along the first direction perpendicular to the top wall 11'. The first mold and/or the mold cavity 331' is located behind the passageway 10' for having good waterproof or sealing effect. Only the upper surface 211' of the end portion 210', the side surface 213' of the end portion 210', and the lower surface 212' of the contacting portion 21 are exposed outwardly via the tongue portion 31' which is pressed against by the second mold.

Referring to FIGS. 1, 4, 6, and 8, a difference between the second mold pressing against the end portion 210', 210 of the contacting portion, 21, 21' in the first and second embodiments is that: the second mold pressing against the side surface 213' of the end portion 210' in the second embodiment but not in the first embodiment.

In the first and second embodiments of the present invention, The passageway 10, 10' is jointly formed by the top wall 11, 11', the bottom wall 12, 12', the pair of side walls 13, 13', and the base portion 33, 33' of the insulative housing 3, 3' for inserting a mating connector.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A waterproof electrical connector comprising:

a metallic shell;

a plurality of terminals partly disposed inside the metallic shell, each terminal comprising a contacting portion, a retaining portion extending downwardly from the contacting portion, and a soldering portion extending backwardly from the retaining portion, each terminal defining a contacting region; and an insulative housing insert-molded with the metallic shell and the terminals, the insulative housing comprising a base portion, a tongue portion extending forwardly from the base portion, and a cover portion extending forwardly from the base portion and at least partly covering the metallic shell, the tongue portion retaining and exposing the terminal contacting portion, the base portion retaining the terminal retaining portion while exposing the terminal soldering portion;

the metallic shell and the base portion forming a passageway, the base portion having a mold cavity extending through an upper surface thereof, the contacting region exposed to outside via the mold cavity; wherein the mold cavity and the passageway are spaced apart from each other along an insertion direction; wherein the mold cavity extends through the base portion along a first direction perpendicular to the tongue portion, the contacting region is a part of the contacting portion and defines an upper surface, a lower surface, and a side surface, and the upper surface and the lower surface are exposed outwardly via the mold cavity; wherein the mold cavity extends through an upper surface of the base portion along a first direction perpendicular to the tongue portion, the contacting region includes a part of the contacting portion and a part of the retaining portion and defines an upper surface, a rear surface, and a side surface, and the upper surface and the rear surface are exposed outwardly via the mold cavity.

2. The waterproof electrical connector as claimed in claim 1, wherein the contacting portion includes a Z-shaped end portion at a front end thereof, the end portion defines an upper surface and a side surface, and the upper surface of the end portion is exposed outwardly from the tongue portion.

3. A method for making a waterproof electrical connector, comprising the steps of:

providing a metallic shell and a plurality of terminals, the metallic shell defining a passageway, each terminal defining a contacting region and comprising a contacting portion, a retaining portion extending downwardly from the contacting portion, and a soldering portion extending backwardly from the retaining portion;

inserting the contacting portions of the terminals in the passageway from a rear end of the metallic shell along an extraction direction, and each contacting portion of the terminal defining an upper surface, a lower surface, and a side surface;

pressing at least one first mold against a rear portion of the contacting portion for positioning the terminal;

inserting at least one second mold in the passageway along an insertion direction to press against the upper surface of the front end of the contacting portion and the lower surface of the contacting portion for positioning the terminal;

forming an insulative housing by insert-molding, cutting off material strips of the metallic shell and the terminals, and removing the at least one first mold, the at least one second mold, and the third mold to define at least one mold cavity, the insulative housing comprising a base portion, a tongue portion extending forwardly from the base portion, and a cover portion extending forwardly from end edges of the base portion and at least partly covering the metallic shell, the contacting portion retained in the tongue portion and exposed outwardly from the tongue portion, the retaining portion retained in the base portion, the soldering portion extending outwardly from the insulative housing, the at least one mold cavity located at the base portion of the insulative housing, the contacting region exposed outwardly via the at least one mold cavity.

4. The method as claimed in claim 3, wherein the step of pressing comprises pressing the at least one first mold against the upper surface and the lower surface of the contacting portion.

5. The method as claimed in claim 3, wherein the step of pressing comprises pressing the at least one first mold against the upper surface of the contacting portion and a rear surface of the retaining portion.

6. The method as claimed in claim 3, wherein the step of inserting at least one second mold comprises pressing the at least one second mold against an upper end surface of the contacting portion.

7. The method as claimed in claim 6, further comprising a step of forming an end portion of the contacting portion into Z-shaped.

8. An electrical connector comprising:

a metallic shell defining a passageway surrounded by opposite top and bottom walls in a vertical direction, and opposite lateral side walls in a transverse direction perpendicular to said vertical direction, the passageway of said shell forwardly communicating with an exterior via a front opening in a front-to-back direction perpendicular to both said vertical direction and said transverse direction;

an insulative housing unitarily forming a rear base portion, a tongue portion forwardly extending from the base portion in said front-to-back direction, and received in the passage, and a cover portion forwardly extending from the base portion and enclosing the shell therein; and a plurality of contacts integrally formed with the tongue portion and the base portion, each of said contacts defining a horizontal contacting section exposed upon the tongue portion, a tail section extending out of the rear base portion for mounting to a printed circuit board, and a connecting sections linked between the horizontal contacting section and the tail section and rearwardly hidden from an exterior by the base portion; wherein in alignment with a specific position of the contacting section of each of the contacts in a vertical direction, the base portion forms a mold cavity extending through an upper side of the base portion in the vertical direction so as to allow a first mold piece to extend therethrough in the vertical direction from the upper side of the housing to downwardly abut against an upper surface of the connecting section of the corresponding contact and a second mold to extend into the passageway from said front opening to upwardly abut against the contacting section of the corresponding contact for securing said contact in position in a balanced manner in the vertical direction during an insert molding process of integrally forming the housing with both the shell and the contacts.

9. The electrical connector as claimed in claim 8, wherein the connecting section of the contact defines a vertical segment received in the mold cavity so as to allow the corresponding mold piece to abut against a back side of the connecting section of the corresponding contact for prevent rearward movement of the contact during the insert molding process.

10. The electrical connector as claimed in claim 8, wherein a portion of the shell extends through the base portion of the housing in the front-to-back direction.

11. The electrical connector as claimed in claim 8, wherein the specific position of each of said contacts is located at a same location in the front-to-back direction so that the mold cavities of the base portion are unified together in the transverse direction as one large mold cavity.

12. The electrical connector as claimed in claim 8, wherein the connecting section forms an upside-down L-shape configuration.

13. The electrical connector as claimed in claim 8, wherein the shell further forms a pair of latch slots for locking with a pair of corresponding latches of a complementary plug connector, and the cover portion forms a pair of holes in alignment with the corresponding latch slots, respectively, in the vertical direction.

14. The electrical connector as claimed in claim 8, wherein said mold cavity further extends through a bottom side of the base portion in the vertical direction so as to allow a third mold piece to extend into the mold cavity from the bottom side of the base portion to upwardly abut against the connecting section of the corresponding contact.

15. The electrical connector as claimed in claim 14, wherein the specific position of each of said contacts is located at a same location in the front-to-back direction so that the mold cavities of the base portion are unified together in the transverse direction as one large mold cavity.

16. The electrical connector as claimed in claim 8, wherein the shell forms a pair of downward extending engaging sections exposed to an exterior for mounting to the printed circuit board, and a pair of retaining legs embedded with the base portion.

17. The electrical connector as claimed in claim 16, wherein the shell forms a pair of openings due to the pair of engaging sections, and said pair of openings are occupied by the covering portion.

* * * * *